US005572828A

United States Patent [19]

Westfall

[11] Patent Number: 5,572,828

[45] Date of Patent: Nov. 12, 1996

[54] PIN LOCK FOR TILT SASH LOCK SHOE

[75] Inventor: Norman R. Westfall, deceased, late of Rochester, N.Y., by Jean Westfall, executrix

[73] Assignee: Caldwell Manufacturing Company, Rochester, N.Y.

[21] Appl. No.: 387,455

[22] Filed: Feb. 13, 1995

[51] Int. Cl.[6] ..... E05D 15/22

[52] U.S. Cl. ..... 49/181; 49/446; 49/453

[58] Field of Search ..... 49/181, 161, 176, 49/453, 446

[56] References Cited

U.S. PATENT DOCUMENTS

| | | | |
|---|---|---|---|
| 2,987,758 | 6/1961 | Osten, Sr. | 49/181 X |
| 3,222,733 | 12/1965 | Wahlfeld et al. | 49/181 |
| 3,399,490 | 9/1968 | Hettinger | 49/176 X |
| 3,429,071 | 2/1969 | Phillips | 49/181 |
| 3,797,168 | 3/1974 | Trout | 49/181 |
| 4,068,406 | 1/1978 | Wood | 49/181 |
| 4,914,861 | 4/1990 | May | 49/181 |
| 4,930,254 | 6/1990 | Valentin . | |
| 5,069,001 | 12/1991 | Makarowski . | |
| 5,189,838 | 3/1993 | Westfall . | |
| 5,243,783 | 9/1993 | Schmidt et al. | 49/181 |

*Primary Examiner*—Philip C. Kannan
*Attorney, Agent, or Firm*—Eugene Stephens & Associates

[57] ABSTRACT

A sash pin engaging a locking element of a tilt shoe has a downwardly oriented hook that engages an edge of the locking element when the sash is untilted so that the sash pin cannot be accidentally withdrawn from the shoe. This avoids all the problems that can be encountered in reassembling an accidentally withdrawn sash pin.

28 Claims, 5 Drawing Sheets

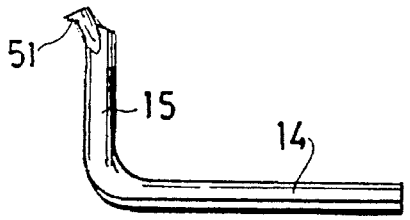
FIG. 6A
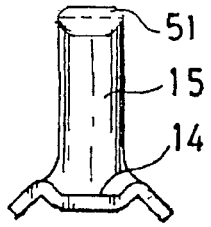
FIG. 6B
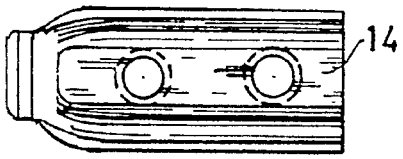
FIG. 6C
FIG. 7
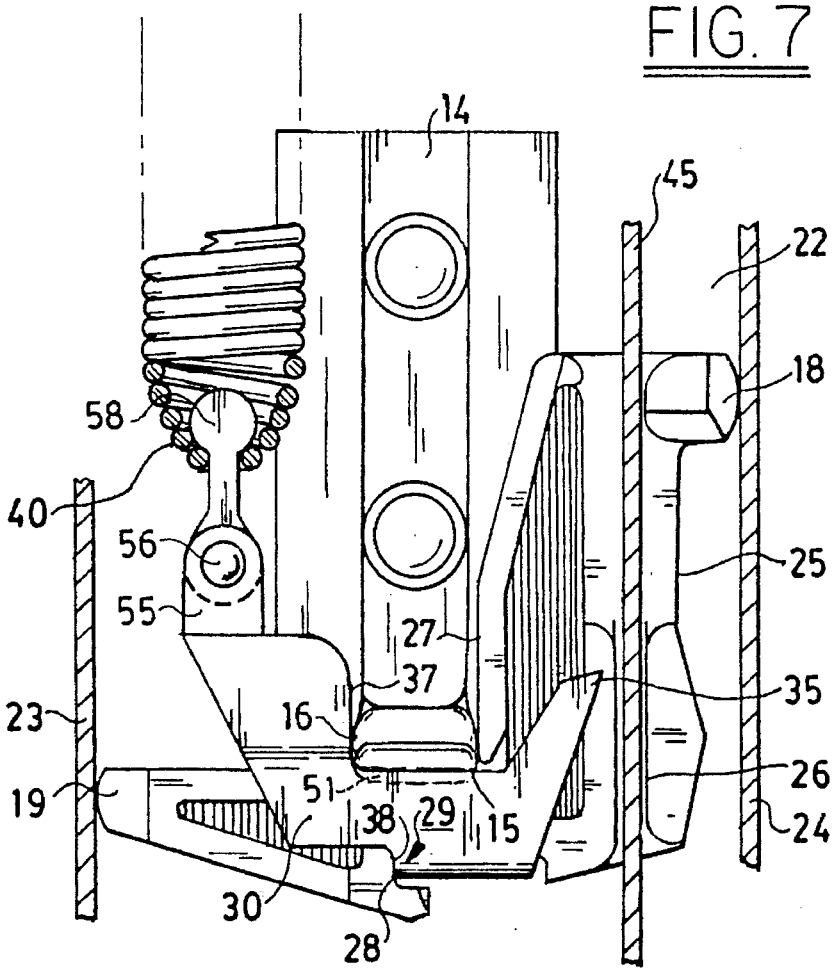

PIN LOCK FOR TILT SASH LOCK SHOE

FIELD OF INVENTION

The field of the invention is lock shoe systems for tilt sash windows.

BACKGROUND

In tilt sash window systems, it is advantageous to have sash pins that lock within sash shoes when window sash are untilted. Accidental withdrawal of untilted sash pins from counterbalanced shoes can cause several problems, depending on the operation of the shoes. Accidental sash pin withdrawal is also not uncommon. A reason for this is that when assembled windows are carried around construction sites before installation in a building, they are often carried by frame side or stile members, which can bow the frame sides and extract the sash pins from the sash shoes. A term that summarizes the problem of accidentally withdrawing sash pins from shoes and refers to the way windows are usually carried about construction sites is "suitcasing".

For shoes that do not automatically lock when sash pins are accidentally extracted, pulling sash pins out of sash shoes by suitcasing sends the shoes flying like projectiles within the window jambs, under the force of counterbalance springs attached to the shoes; and this can break counterbalance components and require at least reassembling and possibly rebuilding the window. Some shoes lock automatically if a sash pin is withdrawn; but problems can still occur by pulling sash pins out of sash shoes, even if the shoes lock in place. Once pulled from shoes, the sash pins may not go back into proper position; and reconnecting the pins properly with the shoes can cause problems at a construction site. The sash pins could end up pressing against the sash shoes in positions where they are unable to enter the shoes, for example; or the sash pins could end up underneath the shoes instead of properly positioned above the bottom of the shoes. Either of these problems can lead to frustration, lost time, and possible breakage of components.

U.S. Pat. Nos. 4,930,254 and 5,069,001 address this problem with sash pins that interlock with window jambs when the sash are untilted. This requires specially constructed jambs and sash shoes, however, to provide an operating space for the lock elements extending laterally from the sash pins.

SUMMARY OF THE INVENTION

This invention solves the suitcasing problem with an interlock between a sash pin and a sash shoe, rather than between a sash pin and a window jamb. The sash pin interlock is operative so that a sash pin cannot be extracted from a sash shoe when the sash is untilted. The interlock is inoperative when the sash tilts so that the sash pin can be removed from the shoe when the sash is tilted and the shoe is locked. The sash pin interlock thus occurs only when the shoe is unlocked, which is when an interlock is needed to prevent the suitcasing effect.

The preferred sash pin interlock occurs with a locking element carried on the sash shoe to lock the shoe when the sash is tilted. Tilting the sash and its sash pin enables the locking element to lock the shoe and also frees the pin for escape from the locked shoe, if desired. When the shoe is unlocked, though, the sash pin interlocks with the locking element to prevent any escape of the sash pin from the shoe. This form of interlock does not require any modification of the window jamb and needs only slight modification of the sash pin and the lock shoe.

A preferred embodiment of the invention is an improvement on the lock shoe shown in coassigned U.S. Pat. No. 5,189,838, which has a locking element carried on a lock shoe and operatively engaged by a sash pin. A counterbalance force is applied to the shoe via the locking element, and the tilted or untilted position of the sash pin controls operation of the locking element. Such an arrangement can accommodate a preferred embodiment of sash pin interlock by forming a hook on the sash pin to engage an edge of the locking element whenever the shoe is unlocked. Tilting of the sash and its pin turns the hook away from an interlock with the edge of the shoe locking element, to free the sash pin for removal from the shoe. When the sash is untilted, though, the upward bias of the locking element against the sash pin ensures that the hook on the sash pin will interlock with the shoe locking element and prevent any escape of the pin from the shoe.

DRAWINGS

Figure 1:
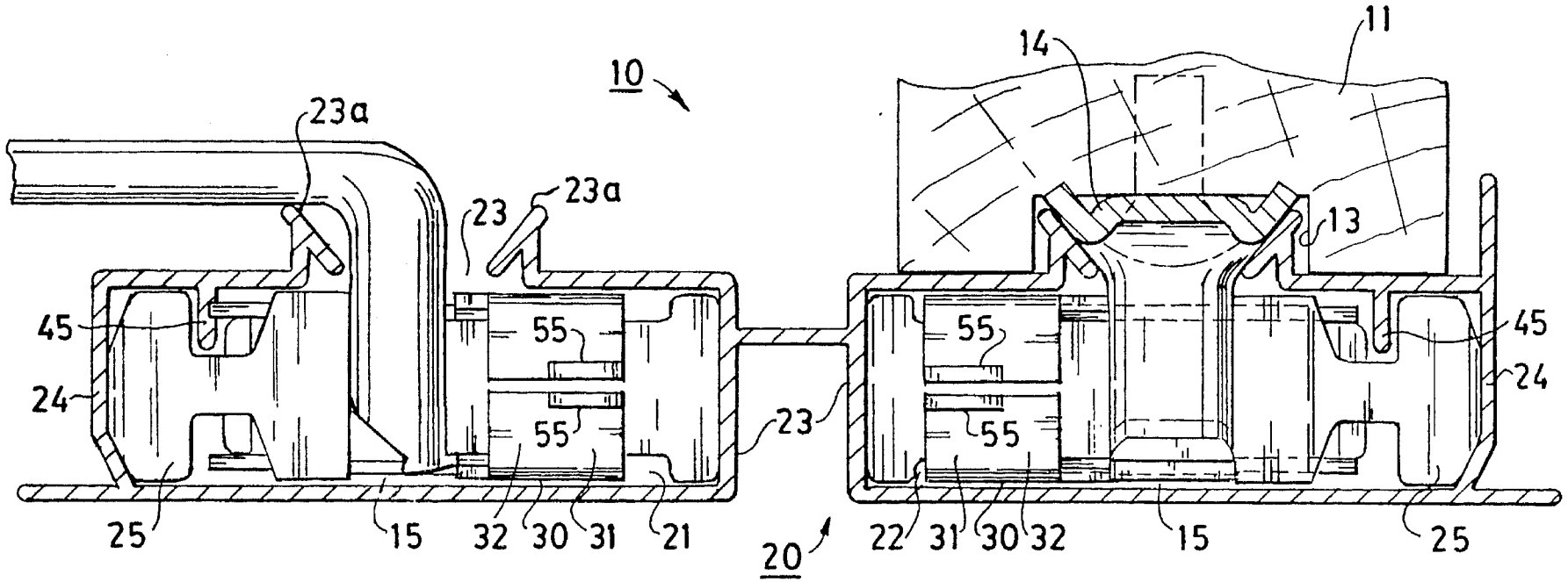
FIG. 1 is a cross-sectional view of a preferred pin locking improvement on a lock shoe system, showing shoes without counterbalance springs running in resin jamb channels for a double-hung window, with a fragment of an untilted sash shown running against the right hand channel, and the sash pin and support bracket for a tilted sash shown for the left hand channel.
Figure 2:
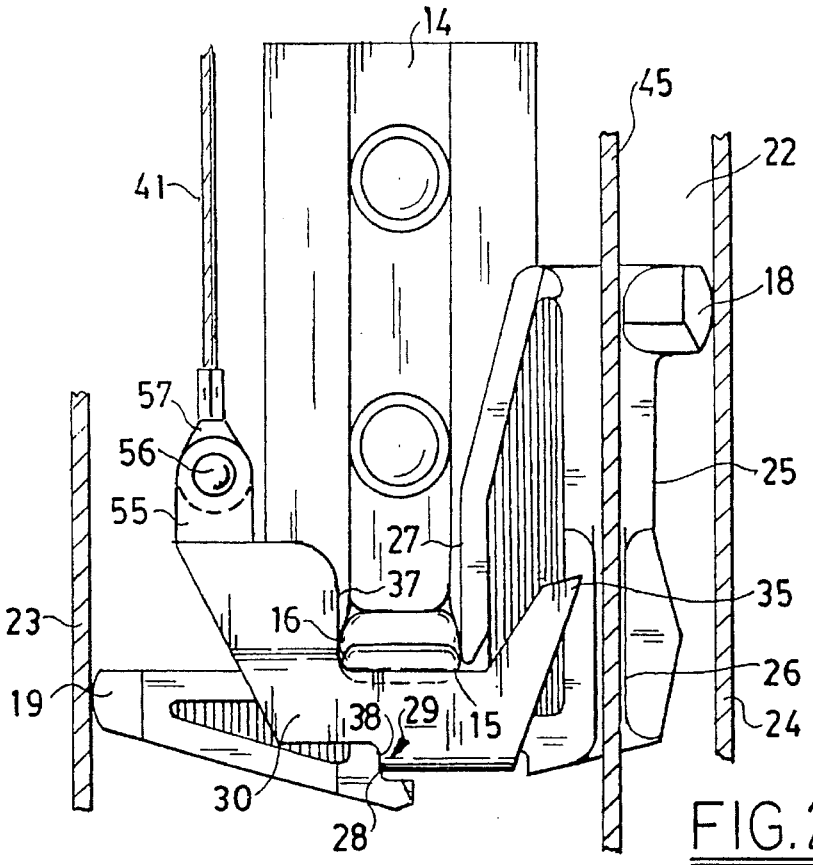
FIG. 2 is a partially fragmentary, elevational view of a lock shoe, sash pin and bracket, and counterbalance spring in an untilted sash position, corresponding to the position shown in the right hand jamb liner channel of FIG. 1.
Figure 3:
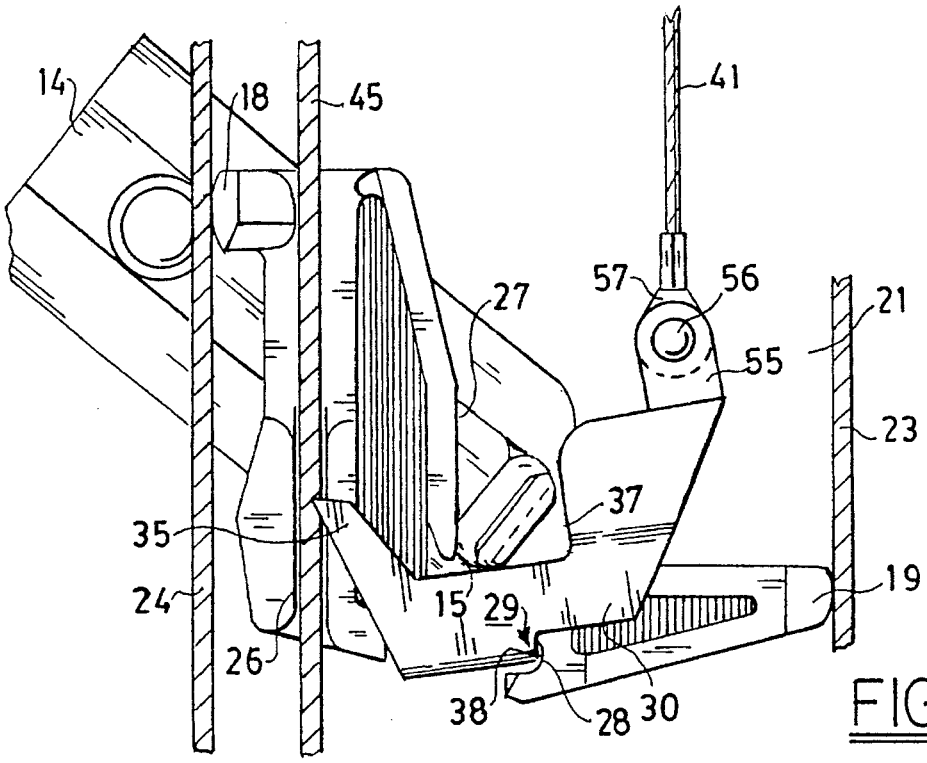
FIG. 3 is a partially fragmentary, elevational view of a lock shoe, sash pin and bracket, and counterbalance spring in a tilted sash position, corresponding to the position shown in the left hand channel of FIG. 1.
Figure 4A:
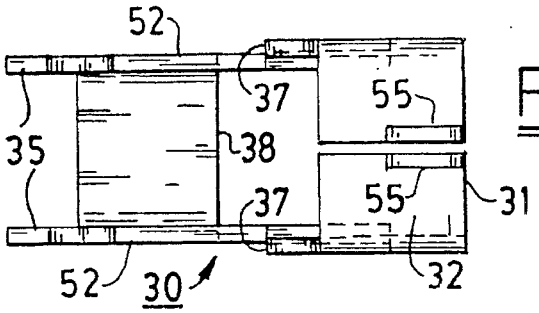
Figure 4B:
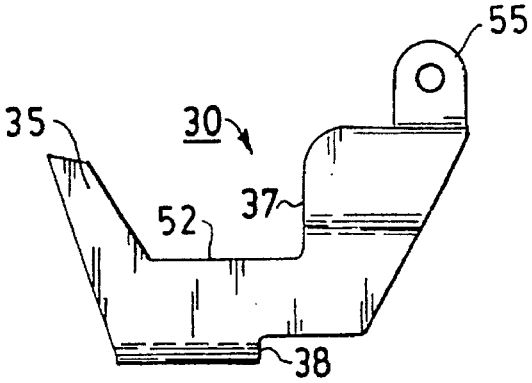
Figure 4C:
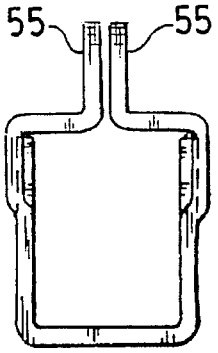

FIGS. 4A, B, and C are respectively plan, elevation, and end views of a locking element for the lock shoe system of FIGS. 1–3.

Figure 5A:
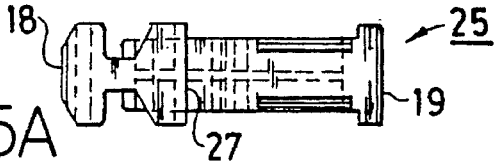
Figure 5B:
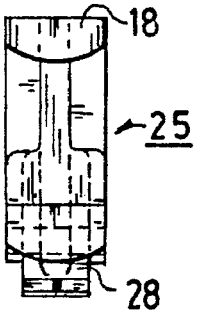
Figure 5C:
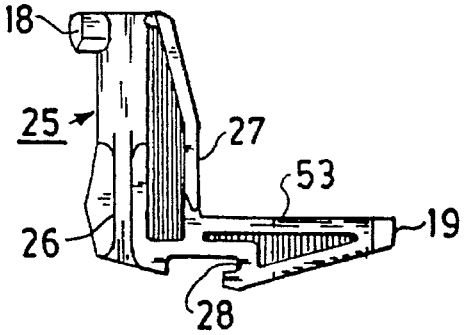

FIGS. 5A, B, and C are respectively plan, end, and elevation views of a shoe for the system of FIGS. 1–3.

FIGS. 6A, B, and C are respectively elevation, end, and plan views of a sash pin and bracket for the system of FIGS. 1–3.

FIG. 7 is a partially fragmentary, elevational view, similar to the view of FIG. 2, and showing a different form of connector between a counterbalance spring and a shoe locking element.

Figure 8:
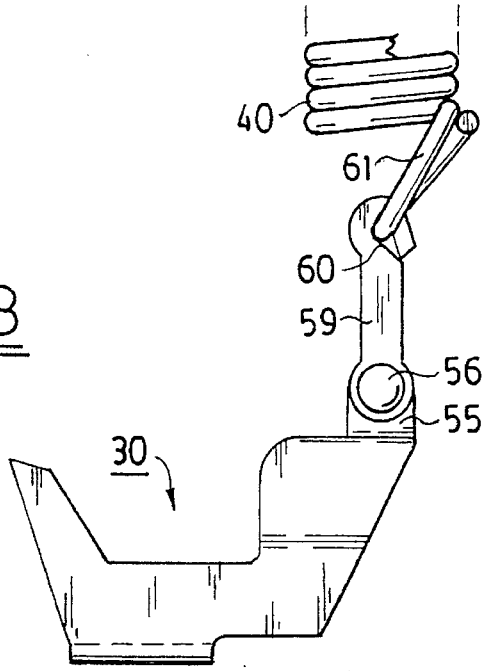

FIG. 8 is a fragmentary, elevational view of a locking element and alternative connector to a counterbalance spring.

Figure 9:
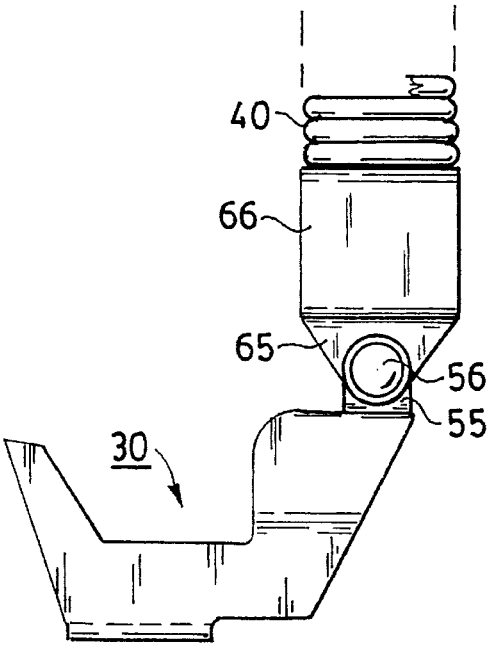

FIG. 9 is a fragmentary view of the locking element showing another alternative connector to a counterbalance spring.

Figure 10:
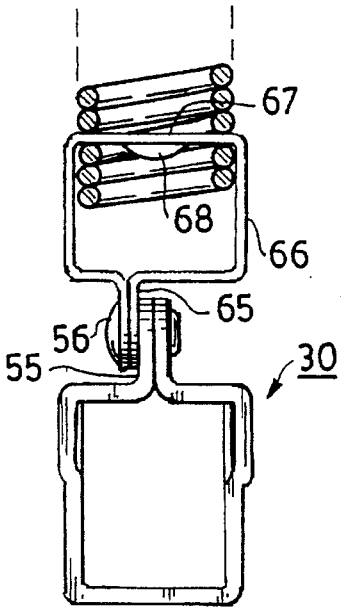

FIG. 10 is an end view of the locking element and connector of FIG. 9.

DETAILED DESCRIPTION

Before explaining the interlock between the sash pin and the locking element of the sash shoe, to prevent the suitcasing effect, the basic operation of the tilt sash shoe will be explained. This also saves the reader from referring back to U.S. Pat. No. 5,189,838.

The portion of a window 10 illustrated in FIG. 1 includes, on the right hand side, a fragment of an untilted sash 11 and, on the left hand side, a tilted bracket 14 and pin 15 attached to a tilted sash that is omitted from FIG. 1, to simplify the illustration. Bracket 14 and pin 15 are also shown in the right hand side of FIG. 1 where bracket 14 is secured to sash 11 within a groove 13 formed in sash 11. Bracket 14 tilts with the sash it is attached to, and this tilts sash pin 15 as explained more fully below. Three views of bracket 14 are illustrated in FIGS. 6A–C. In the cutaway views of FIGS. 2 and 3, bracket 14 and sash pin 15 are illustrated in an untilted position in FIG. 2 and in a tilted position in FIG. 3, with the corresponding sash omitted from the view in each case.

Jamb liner 20 is illustrated as formed of extruded resin material, which is commonly used in the window art, and as having a pair of sash channels 21 and 22, which is required if the window is double-hung. Single-hung windows with a single movable sash are also possible, and jamb liners can have many different configurations. Each shoe channel of jamb liner 20 has a slot 23 that receives sash pin 15 for supporting a sash as it moves up and down between a pair of jamb liners 20. A spring or resilient cushion (not shown) allows jamb liner 20 to move laterally away from a sash as it tilts so that the ridges 23*a* on opposite sides of slot 23 can move aside of a tilted sash and bracket 14 can tilt clear of ridges 23*a*.

A shoe 25 runs vertically in each shoe channel of jamb liner 20 on each side of a window so that a pair of shoes 25 supports any sash that is movable vertically within the window. Each shoe 25 carries a locking element 30, which connects to a counterbalance element such as a spring 40, shown in FIG. 7.

Locking element 30 has a biting edge 35 that can bite into and lock against a rib 45 that extends into each shoe channel of jamb liner 20. Locking rib 45 is spaced from the end or side walls of shoe channels 21 and 22 so that shoe 25 can straddle or extend around locking rib 45 and back up rib 45 against the biting force of edge 35 of locking element 30. This is accomplished in the illustrated preferred embodiment by spacing locking rib 45 inward from outer channel wall 24 of each respective shoe channel of jamb liner 20. This leaves room between rib 45 and wall 24 for shoe surface 26 to extend along the side of rib 45 opposite to the side engaged by biting edge 35.

Locking element 30 is carried on shoe 25 so that it is free to pivot slightly relative to shoe 25. Many pivot arrangements can accomplish this, but I prefer that locking element 30 be arranged to straddle shoe 25 and extend underneath shoe 25 to abut against shoe 25 in pivot region 29. Such an arrangement has several advantages. It eliminates a separate pivot pin and thus simplifies the construction, and it also makes the assembly of locking element 30 and shoe 25 a simple matter of slipping locking element 30 over shoe 25. Pivot region 29 is preferably formed by an abutment 38 on locking element 30 engaging an abutment 28 on shoe 25. The interengagement of abutments 28 and 38 establishes a pivot axis in region 29, about which locking element 30 can pivot relative to shoe 25.

A counterbalance element, such as spring 40 or a cord or cable 41 extending from a spring, is connected to locking element 30 to bias locking element 30 both upwardly and into locking position. The upward bias of locking element 30 also provides an upward counterbalance force on shoe 25, which in turn supports sash pin 15 to counterbalance a sash. The pivoting effect of the upward counterbalance force on locking element 30 biases biting edge 35 into locking engagement with rib 45, to lock shoe 25 against upward travel. Pin 15, by its presence and tilt angle in its operating position in shoe 25, controls the locking movement of element 30 so that shoe 25 locks only when a sash is tilted or removed from its normal vertical position between jamb liners 20.

Shoe 25 has a surface 27 confronting an opposed surface 37 of locking element 30, and sash pin 15 fits between confronting surfaces 27 and 37. These confronting surfaces form an open top slot into which pin 15 can be lowered, for replacing a sash into operative position. This has the advantage of letting a pin 15 of a previously removed sash be replaced into its operating position in shoe 25 simply by lowering pin 15 downward from above a locked shoe 25, which causes pin 15 to slide into position between confronting surfaces 37 and 27. This is much more convenient than having to insert a sash pin laterally into a recess in a locked shoe.

Sash pin 15 has a non-circular shape, preferably with rounded ends 16 as illustrated. The non-circular shape gives sash pin 15 a width greater than its thickness so that its horizontal dimension changes when it tilts from vertical toward horizontal. The horizontal dimension of sash pin 15 separates confronting surfaces 27 and 37 so that in an untilted position, as shown in FIG. 2, sash pin 15 separates confronting surfaces 27 and 37 by a maximum amount, which is enough to hold locking element 30 in an unlocked position with biting edge 35 clear of locking rib 45. Thus, in the normal vertical position of a sash, with sash pin 15 oriented as shown in FIG. 2, shoe 25 is unlocked and free to move vertically so that a sash can be raised and lowered.

When a sash tilts, pin 15 also tilts, as illustrated in FIG. 3; and tilting makes the non-circular shape of pin 15 reduce the separation of confronting surfaces 27 and 37, allowing locking element 30 to pivot as its confronting surface 37 approaches closer to shoe surface 27. This moves biting edge 35 into locking engagement with rib 45 and locks shoe 25 against moving upward under the bias of counterbalance element 40.

Shoe 25 also locks if pin 15 is withdrawn laterally from shoe 25, because this also allows locking element surface 37 to approach closer to shoe surface 27. Lateral withdrawal of pin 15 from an unlocked shoe 25 does not normally occur, but can be accomplished by carrying an assembled window in suitcase fashion so that the jambs are bowed enough for withdrawing pin 15 from shoe 25. The invention prevents any such pin withdrawal, as explained below.

In the illustrated preferred embodiment of a tilt sash lock shoe system, shoes 25 can be used in either right hand or left hand positions on either side of a sash, and pins 15 can tilt in either direction relative to shoes 25 to accomplish the locking shown in FIG. 3. Also, locking element 30, straddling shoe 25, preferably has a pair of biting edges 35, even though only one of the biting edges 35 actually locks against rib 45 in any shoe channel. The effect of this can be seen in FIG. 1, where the shoe in the right hand channel is rotated 180° from the shoe in the left hand channel. In each channel 21 and 22, locking rib 45 is preferably disposed on the sash side of the channel so that reversing a shoe, to orient it respectively in one of the channels, disposes a different one of the biting edges 35 adjacent a locking rib 45. Placing rib 45 on the sash side of the shoe channel is preferred for minimizing the distance between the tilted sash and the locking point. It is also possible to use two locking ribs 45 disposed on opposite sides of each channel so that both biting edges 35 bite into and lock against a respective one of the ribs 45.

Preventing accidental withdrawal of pin 15 from shoe 25, from suitcasing an assembled window, is accomplished by a hook 51 formed on sash pin 15 to interlock with an edge 52 of locking element 30. Hook 51 is preferably formed on a free end of sash pin 15 by swaging or bending the pin metal so that hook 51 is oriented downward. Edges 52 of locking element 30 are then raised somewhat to be clear of surface 53 of shoe 25. The counterbalance lift applied to shoe 25 exerts a lifting force on locking element 30 that raises edges 52 into engagement with the underside of sash pin 15, which is normally urged downward by the force of gravity. This holds one of the edges 52 of locking element 30 securely in engagement with the underside of pin 15, the free end of which is normally disposed between edges 52.

Any force tending to withdrawn pin 15 from shoe 25 without tilting pin 15 and its corresponding sash brings end hook 51 into an interlocking engagement with one of the edges 52 of locking element 30. This holds the free end of pin 15 between the edges 52 of locking element 30 so that pin 15 cannot escape from locking element 30. This is especially assured by the counterbalance force applied to urge locking element 30 into engagement with the underside of pin 15, regardless of the orientation of the window.

Since the force applied in tending to withdraw sash pin 15 by the suitcasing effect can be considerable, locking element 30 is preferably made strong enough to resist any such force. A preferred way of doing this is to connect the sides of locking element 30 above edges 52 as well as below edges 52 so that edges 52 cannot be readily bent or spread apart. This can be done by forming a pair of registered spring connector eyes 55 on each side of locking element 30 above edges 52. Then a spring connector is preferably attached to eyes 55 by a rivet 56 that holds eyes 55 together while attaching the spring connector.

In the embodiment of FIGS. 2 and 3, the spring connector is an eye 57 attached to a cord or cable 41 leading to a counterbalance spring system. In the embodiment of FIG. 7, the spring connector 58 has a head that interlocks with necked-down terminal coils of a counterbalance spring 40. In the embodiment of FIG. 8, the spring connector 59 has a slot 60 that hooks together with a terminal loop 61 of a counterbalance spring 40. In the embodiment of FIGS. 9 and 10, connector 65 has a spring interlock 66 that straddles counterbalance spring 40 and locks to spring 40 via a span 67 that slides between coils of spring 40. A bent-down tab 68 prevents withdrawal of span 67 from between the coils of spring 40.

Other connectors can be arranged for other types of counterbalance springs, such as torsion springs or constant force springs. The joining of spring connector eyes 55 at an upper region of locking element 30 above edges 52 cooperates with the interconnection of edges 52 at the bottom of locking element 30 to ensure that force applied to end hook 51 of sash pin 15 will not bend or spread apart edges 52.

In operation, sash pin 15 and locking element 30 cooperate as previously described for locking shoe 25 when a sash tilts and for unlocking shoe 25 when a sash is untilted. The addition of hook 51 disposed for engaging one of the edges 52 of locking element 30 ensures that pin 15 cannot be accidentally withdrawn from shoe 25 while an assembled window is being suitcased, for example. Eliminating accidental sash pin withdrawal then eliminates all the problems involved in repositioning the sash pin properly within the shoe so that the window is properly reassembled before installation.

I claim:

1. A combination of a tilt sash shoe carrying a shoe locking element biased into a locking position by a counterbalance element and a sash pin that engages the locking element to hold it out of the locking position when the sash is not tilted, the combination comprising:

a. the sash pin has a hook oriented toward the locking element;

b. the locking element has an edge engaged by the sash pin and oriented to confront the hook for interlocking with the hook;

c. the locking element and the sash pin are arranged so that while the sash is not tilted, movement of the sash pin along a pivot axis of the pin in a direction to escape from engagement with the sash shoe brings the hook into interlock with the edge of the locking element to prevent escape of the sash pin from the sash shoe; and d. the locking element and the sash pin are also arranged so that while the sash is not tilted and the sash pin holds the locking element out of the locking position, the counterbalance element biases the edge of the locking element into engagement with the sash pin so that the bias ensures that the hook confronting the edge of the locking element is held in interlocking engagement with the locking element edge.

2. The combination of claim 1 wherein the locking element and the sash pin are formed of metal.

3. The combination of claim 1 wherein the edge of the locking element is disposed clear of the sash shoe so that the hook of the sash pin is free to move into interlock with the edge without interference from the sash shoe.

4. The combination of claim 1 wherein the edge of the locking element is structurally supported by locking element regions above and below the edge to help resist lateral bending force applied by the hook of the sash pin tending to escape from the sash shoe.

5. The combination of claim 4 wherein sides of the locking element are held together above the edge by a rivet fastening a spring connector to the locking element.

6. The combination of claim 1 wherein the edge of the locking element is oriented upward, and the hook is oriented downward when the sash is untilted and the combination is installed in an upright window.

7. The combination of claim 1 wherein the hook on the sash pin does not interlock with the locking element when the sash pin tilts and enables the locking element to lock the shoe.

8. In a locking tilt shoe for receiving a sash pin of a tilt sash, the improvement comprising:

a. the sash pin engages an edge of a locking element that locks the shoe when the sash tilts;

b. a counterbalance element biases the edge of the locking element into engagement with the sash pin whenever the sash is not tilted;

c. the sash pin has an end hook oriented toward the edge of the locking element when the sash is untilted; and d. the end hook of the sash pin is disposed to interlock with the counterbalance biased edge of the locking element if the sash is not tilted and if the sash pin is moved along the pivot axis of the pin in a direction to escape from the shoe so that the interlock prevents escape of the sash pin from the shoe.

9. The improvement of claim 8 wherein the locking element and the sash pin are formed of metal.

10. The improvement of claim 8 wherein the edge of the locking element is disposed clear of the sash shoe so that the end hook of the sash pin is free to move into interlock with the edge without interference from the sash shoe.

11. The improvement of claim 8 wherein the edge of the locking element is structurally supported by locking element regions above and below the edge to help resist lateral bendine force applied by the end hook of the sash pin tending to escape from the sash shoe.

12. The improvement of claim 11 wherein locking element regions above the edge are joined by a rivet fastening a spring connector to the locking element.

13. The improvement of claim 8 wherein the hook is formed on a free end of the sash pin.

14. The improvement of claim 8 wherein the end hook on the sash pin does not interlock with the locking element when the sash pin tilts and enables the locking element to lock the shoe.

15. A sash pin and tilt sash lock shoe system comprising:

a. a counterbalance bias of the shoe being applied to a locking element carried by the shoe to engage the sash pin so that when the shoe is unlocked, an edge of the locking element is pressed against the sash pin by the counterbalance bias force; and b. a hook on the sash pin being oriented toward the edge of the locking element to interlock with the edge of the locking element if the sash pin is moved along its pivot axis in a direction to escape from the shoe, the interlock of the hook with the counterbalance biased edge of the locking element preventing the sash pin from escaping from the shoe when the shoe is unlocked.

16. The system of claim 15 wherein the locking element extends above and below the edge engaged by the sash pin for strengthening the edge against lateral force of the sash pin moving in the escape direction.

17. The system of claim 15 wherein the sash pin hook is formed on a free end of the sash pin.

18. The system of claim 15 wherein the sash pin and the locking element are formed of metal.

19. The system of claim 15 wherein the edge of the locking element is disposed clear of the sash shoe so that the hook of the sash pin is free to move into interlock with the edge without interference from the sash shoe.

20. The system of claim 15 wherein the sash pin can be lifted from the locking element and removed from the shoe when the shoe is locked.

21. The system of claim 15 wherein the hook on the sash pin does not interlock with the locking element when the sash pin tilts and enables the locking element to lock the shoe.

22. A combination of a sash pin and a tilting lock shoe comprising:

a. a hook on the sash pin oriented to interlock with a locking element on the shoe whenever the shoe is unlocked; and b. a counterbalance spring applying a bias to the locking element that presses the locking element into engagement with the sash pin whenever the shoe is unlocked, the biasing of the locking element against the sash pin ensuring that an interlock between the sash pin hook and locking element occurs if the sash pin is axially moved in a direction of withdrawal from the sash shoe when the shoe is unlocked.

23. The combination of claim 22 wherein the hook on the sash pin does not interlock with the locking element when the sash pin tilts and enables the locking element to lock the shoe.

24. The combination of claim 22 wherein the locking element has an edge disposed in an unlocked position to be biased into engagement with the hook on the sash pin.

25. The combination of claim 24 wherein the sash pin hook is formed on a free end of the sash pin and is oriented downward, and the edge of the locking element is oriented upward.

26. The combination of claim 22 wherein the sash pin and the locking element are formed of metal.

27. The combination of claim 22 wherein the locking element extends above and below the sash pin for strengthening the interlock with the sash pin to resist lateral bending from force tending to withdraw the sash pin from the shoe.

28. The combination of claim 22 wherein a connector to the counterbalance spring is fastened to the locking element above the sash pin.

* * * * *